US007926684B2

(12) United States Patent
Charlier et al.

(10) Patent No.: US 7,926,684 B2
(45) Date of Patent: Apr. 19, 2011

(54) PRESSURIZED ICE CREAM CONTAINER WITH A PISTON

(75) Inventors: Christophe Jean-Marie Yves Charlier, Allonne (FR); Bruno Sadi Henri Delande, Marseille en Beauvaisis (FR); Jean-Francois Andre Alme Launay, La Chapelle aux Pots (FR); Pierre Henri Lebrand, Bonliers (FR)

(73) Assignee: Nestec S.A., Vevey (CH)

( * ) Notice: Subject to any disclaimer, the term of this patent is extended or adjusted under 35 U.S.C. 154(b) by 693 days.

(21) Appl. No.: 11/814,420

(22) PCT Filed: Jan. 18, 2006

(86) PCT No.: PCT/EP2006/000414

§ 371 (c)(1),
(2), (4) Date: Jul. 20, 2007

(87) PCT Pub. No.: WO2006/077097

PCT Pub. Date: Jul. 27, 2006

(65) Prior Publication Data

US 2008/0142541 A1 Jun. 19, 2008

(30) Foreign Application Priority Data

Jan. 21, 2005 (EP) ..... 05100397

(51) Int. Cl.
*B67D 3/00* (2006.01)

(52) U.S. Cl. ..... 222/549; 222/153.14; 222/389; 222/499; 222/521; 222/386.5; 251/149.1

(58) Field of Classification Search ..... 222/153.14, 222/389, 501, 499, 521, 525, 549, 553, 386.5, 222/519, 522, 523, 507, 386; 251/149.1; 137/614.5

See application file for complete search history.

(56) References Cited

U.S. PATENT DOCUMENTS

| | | | | |
|---|---|---|---|---|
| 3,756,476 | A * | 9/1973 | Bonduris | 222/386.5 |
| 4,280,523 | A * | 7/1981 | Norton | 137/74 |
| 6,367,499 | B1 * | 4/2002 | Taku | 137/72 |
| 6,581,806 | B2 * | 6/2003 | Lilienthal | 222/389 |
| 6,814,097 | B2 * | 11/2004 | Girouard | 137/72 |
| 7,150,287 | B2 * | 12/2006 | Kita et al. | 137/72 |
| 2004/0216802 | A1 | 11/2004 | O'Connor et al. | |

FOREIGN PATENT DOCUMENTS

| | | |
|---|---|---|
| EP | 1 439 134 | 7/2004 |
| EP | 1 591 376 | 11/2005 |
| WO | WO 91/10607 | 7/1991 |

* cited by examiner

*Primary Examiner* — Kevin P Shaver
*Assistant Examiner* — Melvin A Cartagena
(74) *Attorney, Agent, or Firm* — K&L Gates LLP

(57) ABSTRACT

A pressurized container (1) for a viscous product, comprising a container body (2) with an opening (9), a piston (3), a dispensing closure (4) attached to the container body opening (9) which comprises closure walls, at least one dispensing aperture (13), at least one closing element (14) that is movable relative to the closure walls between a closed position and an open position, the container (1) further comprising a spring element (15) disposed between said closing element (14) and said closure walls, so as to naturally force the closing element (14) in a position where it closes said aperture (13), wherein the closure walls define a channel (16) with at least one lateral dispensing aperture (13) remote from the container body opening (9), said closing element (14) having the shape of a ring that seals around and is movable relative to the channel (16), by translation along, or by rotation around, an axis which is parallel to the longitudinal axis of the channel (16).

8 Claims, 5 Drawing Sheets

PRESSURIZED ICE CREAM CONTAINER WITH A PISTON

The present invention relates to a pressurized container, preferably a pressurized container for containing a frozen viscous product, said container having a dispensing closure with an improved piston and valve dispensing system.

For the packing and dispensing of products, it is known to use pressurized containers comprising dispensing valves.

A dispensing valve allows a consumer to efficiently dose and dispense the product.

In the following description and for the sake of the clarity of the description, the product contained in the container of the invention is described as soft ice cream. However, it should be understood that this example is not limitative, and that other types of products can also suitably be packaged in the container of the invention.

As shown in FIG. 1 of the attached drawing, a pressurized container 1 comprises a container body 2 with a piston 3 that is movable in translation along the longitudinal axis of the container body. The container further comprises a dispensing closure 4 with a dispensing aperture 5 and a closing valve 6 that is movable relative to the aperture 5 between two configurations, where it closes or opens said aperture.

The piston divides the interior of the container body into two compartments: the lower compartment is filled with pressurized gas that forces the piston to move upwards inside the container body. The second compartment is filled with the product to store and dispense.

When such pressurized containers known in the art are used to contain and dispense viscous products, the dispensing closure comprises a conical valve with an apex 7 oriented towards the interior of the container body. Such a structure is well described for example in European patent application no 04009947.5. The reason for this is: at the time the consumer wishes to dispense the product, he actuates the dispensing closure so that the valve is translated downwards—i.e. toward the interior of the container body—. At this time, the valve moves into the contents and the viscosity of said contents creates a mechanical resistance to the movement of the valve, which is especially important when the contents is a frozen product. Such a resistance requires a lot of force from the consumer for the dispensing actuation.

To prevent such a mechanical resistance, the valve has a conical shape which helps the latter moving into the contents, thus reducing the mechanical resistance to its translation movement.

The known dispensing closures with conical valves that are used with pressurized containers for frozen products require a reasonably low force to actuate, and are reliable.

However, due to the shape of the valve, the piston 3 that is located into the container body has to have a corresponding shape, i.e. with a conical groove 8 in its center, so that when the container body is almost empty and the piston is in the extreme upper portion of said container body, said piston can fit the conical valve and push the remaining product out of the container body. In that way, there is almost no product lost at the end of the dispensing. The position of the piston at the extreme upper portion of the container body is shown in FIG. 1 of the attached drawing.

Two main disadvantages of such a conical shape of the piston are:

- firstly, such a piston is more expensive to manufacture, thus increasing the total price of the pressurized container
- secondly, the volume for compressed air to push the piston upwards into the container body is limited due to its shape. Therefore, for the same efficiency of the piston to press onto the product to force it out of the container, it is necessary to increase the pressure of the pressurized gas. This increases the manufacturing costs, and requires thicker walls of the container body to contain the higher pressure. Thicker walls are more expensive and they increase the container weight, which is clearly undesirable to the consumer.

Therefore, a need exists for a pressurized container for containing and dispensing viscous products which comprises a dispensing closure with a valve, with a structure such that it solves the above mentioned disadvantages of the existing containers.

The present invention addresses the problems set out above with a pressurized container for storing and dispensing a viscous product, said container comprising:

(i) a container body for containing the product, having an opening at its upper side, (ii) a piston which is movable in translation along the longitudinal axis of the container body, and divides the latter in two compartments: a lower compartment filled with pressurized gas that forces the piston in the direction of the opening, and an upper compartment filled with the product, (iii) a dispensing closure attached to the container body opening, and comprising closure walls, at least one dispensing aperture, at least one closing element that is movable relative to the closure walls between a first position where said dispensing aperture is closed, and a second position where the dispensing aperture is open and the product is dispensed, (iv) a spring element disposed between said closing element and said closure walls, so as to naturally force the closing element in a position where it closes said aperture, characterized in that the closure walls define a cylindrical channel which is in fluid contact with the interior of the container body, and comprises at least one lateral dispensing aperture remote from the container body opening, said closing element having the shape of a ring that seals around the channel, and is movable relative to said channel by translation along, or by rotation around, an axis which is parallel to the longitudinal axis of the channel.

In a preferred embodiment of the invention, said channel is vertical, and said lateral dispensing aperture is located at the upper part of said channel.

Also preferably, said closure further comprises at least one actionable means that surrounds said closure walls and said closing element, and comprises at least one connection element that is disposed between said actionable means and said closing element, said connection element being made of a material that is:

- rigid enough, when the temperature of the container is below a predetermined safety temperature, to connect said actionable means and said closing element, thus allowing a consumer to open the dispensing aperture by moving said actionable means, and
- fluid when the temperature of the container is above said safety temperature, so that said actionable means and said closing element are disconnected, thus preventing a consumer to open the dispensing aperture when moving said actionable means.

Said safety temperature is preferably comprised between −35° C. and +50° C., more preferably comprised between −25° C. and −10° C. Advantageously, the connection element is a key.

In a preferred embodiment of the present invention, said actionable means comprises an outer ring that surrounds and is movable relative to said closing element.

Preferably, said product a frozen viscous food product.

The invention will now be described in greater detail, with reference to the attached set of drawings, which represent one embodiment of a container according to the present invention. The following example is given by way of illustration only and in no way should be construed as limiting the scope and subject matter of the invention as described and claimed.

In the following description, and for the sake of clarity, the container of the invention as well as all of its components, are considered in the vertical position, so that the closed side of the container body is in contact with a flat horizontal support, and the side of the container body to which the closure is attached is oriented upwards.

Figure 1:
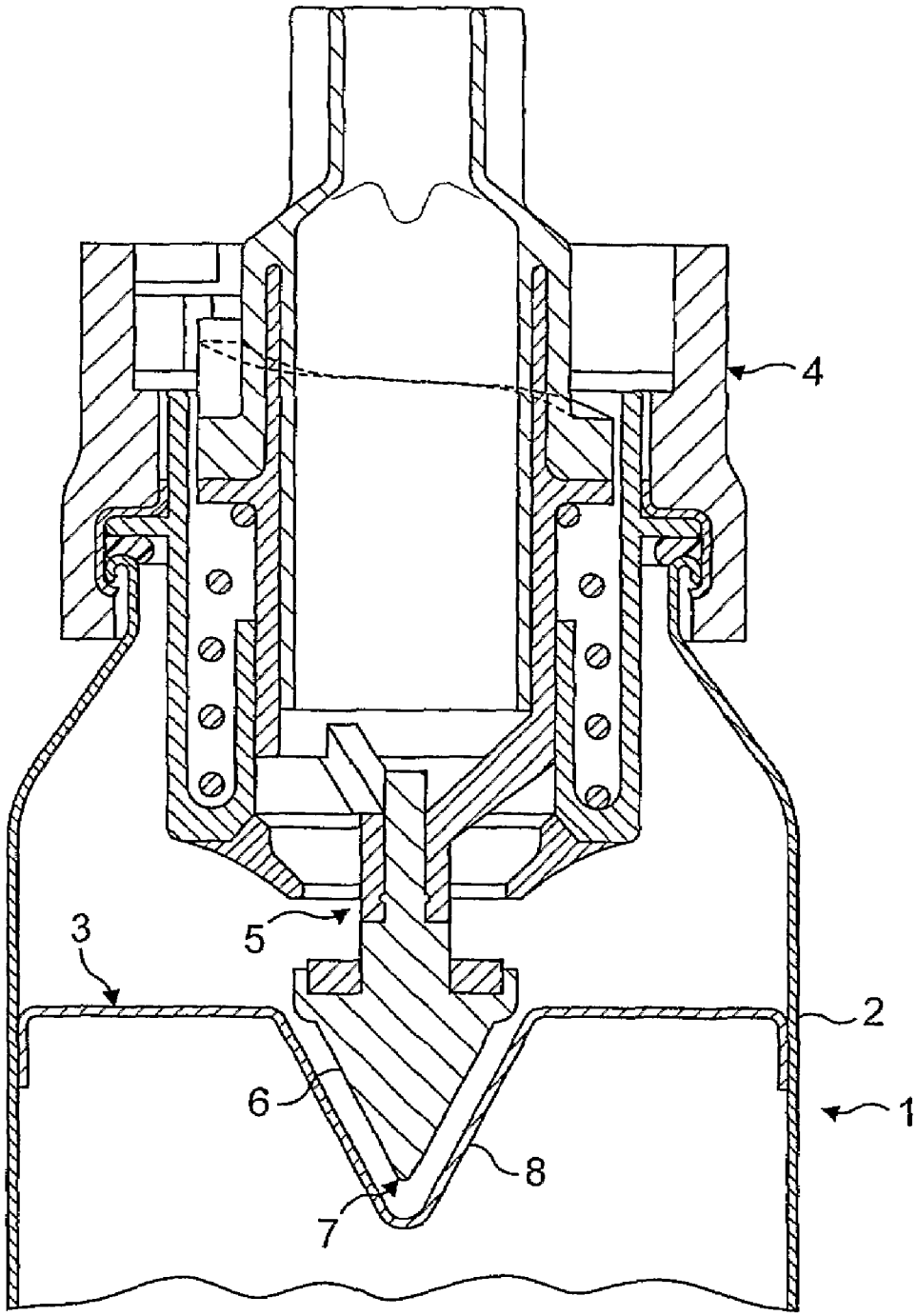
FIG. 1 is a profile cut view of a container according to the prior art.
Figure 2:
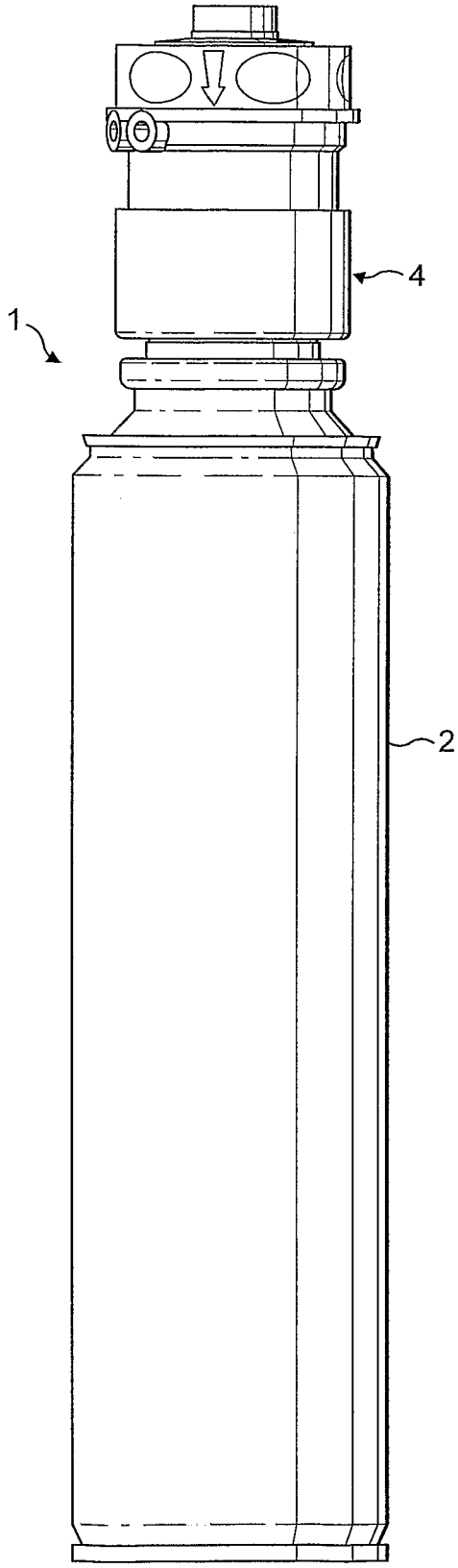
FIG. 2 is a profile view of a container according to the invention.
Figure 3:
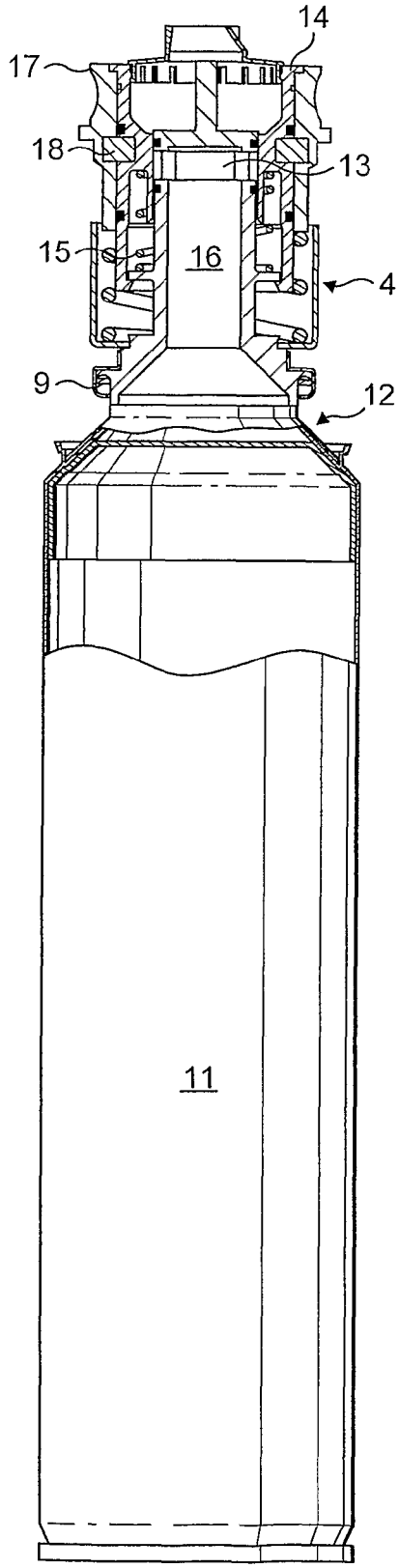
FIG. 3 is a profile cut view of a container according to the invention, with the piston located in the upper portion of the container body.
Figure 4:
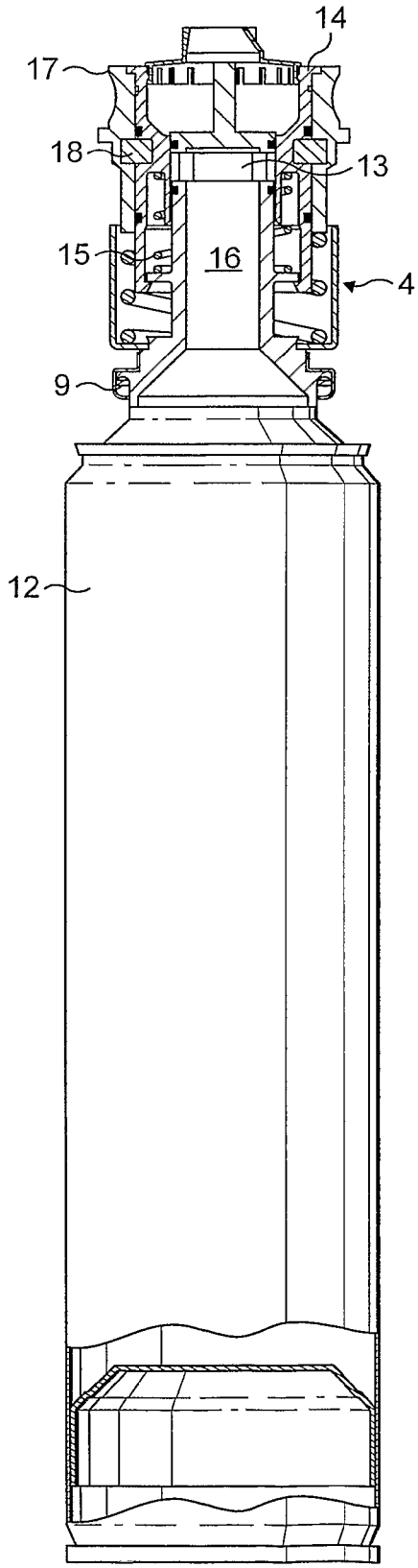
FIG. 4 is a profile cut view of a container according to the invention, with the piston located in the lower portion of the container body.

In the example shown in FIGS. 2 to 4, the longitudinal axis of the container is vertical when said container is considered vertical.

FIG. 2 represents one embodiment of a container according to the present invention.

The container 1 represented in FIG. 2 is a pressurized container for storing and dispensing a frozen viscous product, for example soft ice cream.

Figure 5:
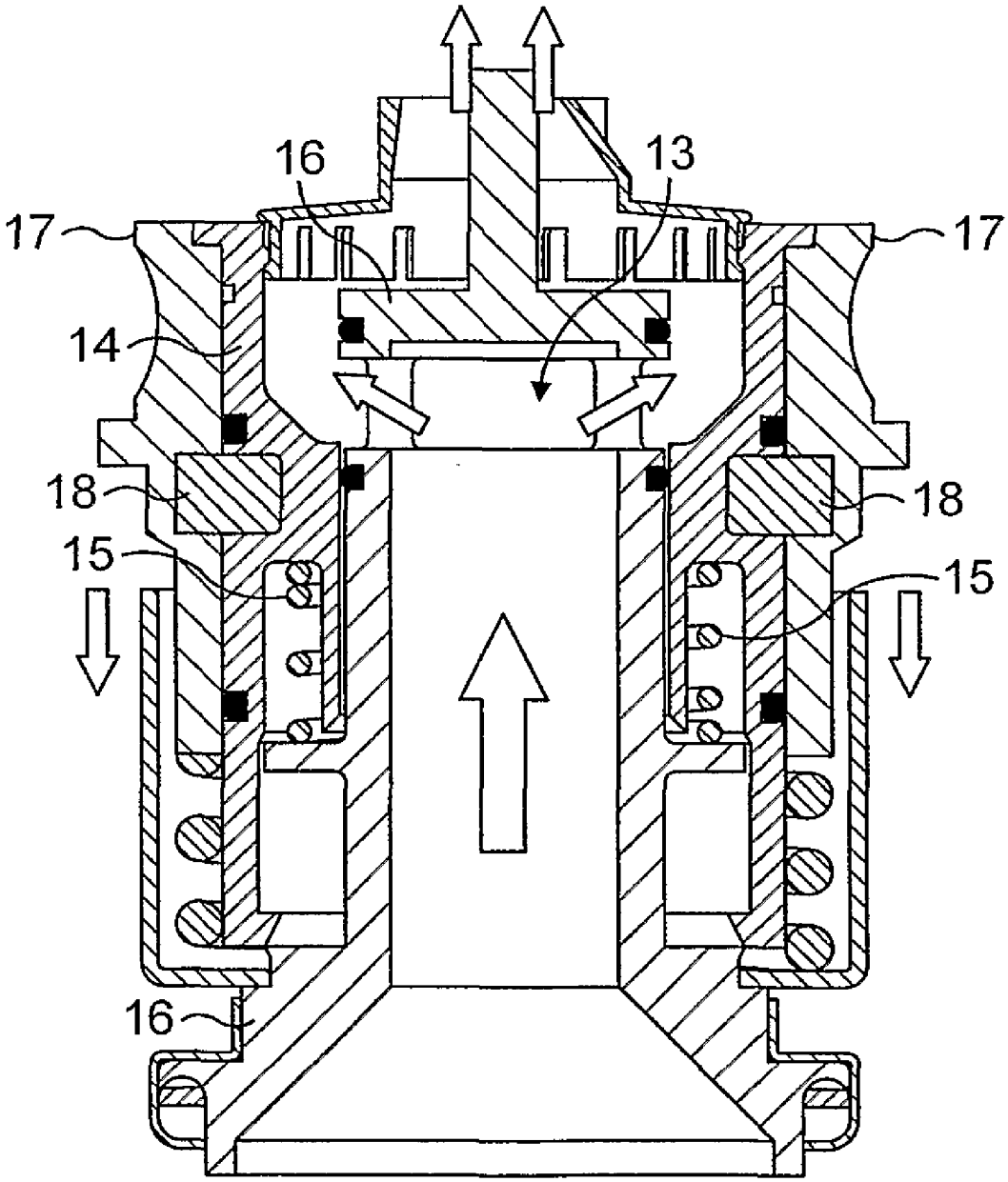
FIG. 5 is an enlarged cut view of a closure according to the invention, in the open configuration.

The container 1 comprises a container body 2 for containing the product, having an opening 9 at its upper side, and a dispensing closure 4 attached to the container body opening 9 which is represented in an enlarged view in FIG. 5.

As illustrated in FIGS. 3 and 4, the container further comprises a piston 3 which is movable in translation along the longitudinal axis of the container body, and divides the latter in two compartments: a lower compartment 11 filled with pressurized gas that forces the piston in the direction of the opening, and an upper compartment 12 filled with the product.

The dispensing closure 4 attached to the container body opening 9, comprises closure walls, at least one dispensing aperture 13, at least one closing element 14 that is movable relative to the closure walls between a first position where said dispensing aperture 13 is closed, and a second position where the dispensing aperture is open and the product is dispensed, as it is forced out by the piston 3.

The container further comprises a spring element 15 disposed between said closing element 14 and said closure walls, so as to naturally force the closing element in a position where it closes said aperture 13.

According to the present invention, the closure walls define a vertical cylindrical channel 16 which is in fluid contact with the interior of the container body 2.

Due to the height of the channel 16 the dispensing aperture 13 is located remote from the container body opening 9.

Moreover, said closing element 14 has the shape of a ring that seals around the channel 16, and is movable relative to said channel by translation along an axis—not represented on the drawing—which is parallel to the longitudinal axis of the channel 16.

As shown in FIG. 5, the lateral dispensing aperture 13 is located at the upper part of said channel 16.

As can be seen in FIGS. 3 to 5, the dispensing closure 4 further comprises an outer ring 17 that surrounds and is movable relative to said closure walls and said closing element, and said closure also comprises one key 18 that is disposed between said outer ring 17 and said closing element 14.

The key 18 is made of a material that is:

rigid enough, when the temperature of the container 1 is below a predetermined safety temperature, to connect said outer ring 17 and said closing element 14, thus allowing a consumer to open the dispensing aperture by moving said actionable means, and fluid, when the temperature of the container 1 is above said safety temperature, so that said outer ring 17 and said closing element 14 are disconnected, thus preventing a consumer to open the dispensing aperture when translating said outer ring downwards.

In the present example, the safety temperature is comprised between −25° C. and −10° C.

As can be understood from the above description, due to the length of the channel, the dispensing aperture of the closure is at a distance from the container body, and also remote from the piston. Moreover, the closing element is a ring that is also remote from the piston, so that the shape of said piston can be simply flat, as seen in FIGS. 3, and 4, whatever the position of the piston inside the container body.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A pressurized container for storing and dispensing a viscous product comprising:

a container body for containing the product, having an opening at its upper side, a piston which is movable along a longitudinal axis of the container body, and divides the container body in two compartments, a lower compartment filled with pressurized gas that forces the piston in a direction of the opening, and an upper compartment filled with the product, a dispensing closure attached to the container body opening, and comprising closure walls, at least one dispensing aperture, at least one closing element that is movable relative to the closure walls between a first position where the dispensing aperture is closed, and a second position where the dispensing aperture is open and the product is dispensed, a spring element located between the closing element and the closure walls, so as to urge the closing element in a position where it closes the aperture, the closure walls define a cylindrical channel which is in fluid contact with the interior of the container body, and comprises at least one lateral dispensing aperture remote from the container body opening, the closing element having a ring shape that seals around the channel, and is movable relative to the channel by translation along, or by rotation around, an axis which is parallel to the longitudinal axis of the channel.

2. A container according to claim 1, wherein the channel is vertical, the lateral dispensing aperture is located at the upper part of the channel.

3. A container according to claim 1, wherein the product is a frozen viscous food product.

4. A pressurized container for storing and dispensing a viscous product comprising:

a container body for containing the product, having an opening at its upper side, a piston which is movable along a longitudinal axis of the container body, and divides the container body in two compartments, a lower compartment filled with pressurized gas that forces the piston in a direction of the opening, and an upper compartment filled with the product, a dispensing closure attached to the container body opening, and comprising closure walls, at least one dispensing aperture, at least one closing element that is movable relative to the closure walls between a first position where the dispensing aperture is closed, and a second position where the dispensing aperture is open and the product is dispensed, a spring element located between the closing element and the closure walls, so as to urge the closing element in a position where it closes the aperture, the closure walls define a cylindrical channel which is in fluid contact with the interior of the container body, and comprises at least one lateral dispensing aperture remote from the container body opening, the closing element having a ring shape that seals around the channel, and is movable relative to the channel by translation along, or by rotation around, an axis which is parallel to the longitudinal axis of the channel, wherein the closure further comprises at least one actionable means that surrounds the closure walls and the closing element, and at least one connection element that is disposed between the actionable means and the closing element, the element being made of a material that is:

rigid enough, when the temperature of the container is below a predetermined safety temperature, to connect the actionable means and the closing element, allowing a consumer to open the dispensing aperture by moving the actionable means, and fluid when the temperature of the container is above the safety temperature, so that the actionable means and the closing element are disconnected, thus preventing a consumer to open the dispensing aperture when moving the actionable means.

5. A container according to claim 4, wherein the safety temperature is between −35° C. and +50° C.

6. A container according to claim 4, wherein the connection element is a key.

7. A container according to claim 4, wherein the safety temperature is between −25° C. and −10° C.

8. A container according to claim 4, wherein the actionable means comprises an outer ring that surrounds and is movable relative to the closing element.

* * * * *